US009449452B2

(12) United States Patent
Otsuka

(10) Patent No.: US 9,449,452 B2
(45) Date of Patent: Sep. 20, 2016

(54) SHEETS PROCESSING APPARATUS

(71) Applicant: KABUSHIKI KAISHA TOSHIBA, Minato-ku (JP)

(72) Inventor: Toru Otsuka, Tokyo (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 14/834,172

(22) Filed: Aug. 24, 2015

(65) Prior Publication Data

US 2015/0363992 A1 Dec. 17, 2015

Related U.S. Application Data

(60) Division of application No. 14/253,591, filed on Apr. 15, 2014, now Pat. No. 9,149,843, which is a division of application No. 12/209,566, filed on Sep. 12, 2008, now Pat. No. 8,733,553, which is a continuation of application No. 11/223,918, filed on Sep. 13, 2005, now abandoned.

(30) Foreign Application Priority Data

Jan. 20, 2005 (JP) ..... 2005-012900

(51) Int. Cl.

| | |
|---|---|
| ***G07F 7/04*** | (2006.01) |
| ***G07D 11/00*** | (2006.01) |
| ***G07D 7/16*** | (2016.01) |

(Continued)

(52) U.S. Cl.

CPC ..... *G07D 11/0084* (2013.01); *B07C 5/00* (2013.01); *B65B 61/025* (2013.01); *B65D 13/02* (2013.01); *G07D 7/16* (2013.01); *G07D 7/18* (2013.01); *G07D 7/187* (2013.01); *G07D 11/0036* (2013.01); *G07D 11/0054* (2013.01); *G07D 11/0051* (2013.01)

(58) Field of Classification Search

CPC ..... B07C 5/00; G07D 7/18; G07D 11/0054; G07D 11/0084

See application file for complete search history.

(56) References Cited

U.S. PATENT DOCUMENTS

| | | | |
|---|---|---|---|
| 4,458,816 | A | 7/1984 | Horino et al. |
| 4,479,049 | A | 10/1984 | Hirose |

(Continued)

FOREIGN PATENT DOCUMENTS

| | | |
|---|---|---|
| EP | 1 271 425 A2 | 1/2003 |
| JP | 60-061461 | 4/1985 |

(Continued)

OTHER PUBLICATIONS

Office Action issued in European Application No. 05017974.6 mailed on Jun. 8, 2016, (6 pages).

*Primary Examiner* — Mark Beauchaine

(74) *Attorney, Agent, or Firm* — Oblon, McClelland, Maier & Neustadt, L.L.P.

(57) ABSTRACT

In a sheet processing apparatus which checks sheets and sorts the sheets for a plurality of cassettes on the basis of the check result and conditions for the sheets which are assigned to the respective cassettes, conditions for sheets such as bill types and bill states which are assigned to the respective cassettes are displayed on a display unit. When an instruction to save these setting contents is issued while a cassette and conditions for sheets which are displayed on the display unit are selected, the selected conditions for sheets are assigned to the selected cassette.

1 Claim, 10 Drawing Sheets

(51) Int. Cl.

| | |
|---|---|
| ***G07D 7/18*** | (2006.01) |
| ***B07C 5/00*** | (2006.01) |
| ***B65D 13/02*** | (2006.01) |
| ***B65B 61/02*** | (2006.01) |

(56) References Cited

U.S. PATENT DOCUMENTS

| | | | | |
|---|---|---|---|---|
| 4,629,382 | A | 12/1986 | Ueshin | |
| 4,694,963 | A * | 9/1987 | Takesako | G07D 11/0048 209/534 |
| 4,825,378 | A | 4/1989 | Yuge | |
| 4,905,840 | A * | 3/1990 | Yuge | G07D 11/0072 209/534 |
| 5,076,441 | A | 12/1991 | Gerlier | |
| 5,522,511 | A | 6/1996 | Sakoguchi et al. | |
| 7,789,243 | B2 | 9/2010 | Hornung et al. | |
| 2002/0153290 | A1 | 10/2002 | Otsuka | |
| 2003/0015395 | A1 | 1/2003 | Hallowell et al. | |
| 2004/0144695 | A1 | 7/2004 | Kuru et al. | |
| 2007/0278138 | A1 | 12/2007 | Calverley et al. | |

FOREIGN PATENT DOCUMENTS

| | | |
|---|---|---|
| JP | 01-220086 | 9/1989 |
| JP | 03-188592 | 8/1991 |
| JP | 04-242882 | 8/1992 |
| JP | 06-076144 | 3/1994 |
| JP | 2000-020783 | 1/2000 |
| JP | 2000-123221 | 4/2000 |
| JP | 2005-004526 | 1/2005 |
| WO | WO 01/59723 A1 | 8/2001 |
| WO | WO 03/067532 A1 | 8/2003 |

* cited by examiner

SHEETS PROCESSING APPARATUS

CROSS-REFERENCE TO RELATED APPLICATIONS

This application is a divisional of co-pending U.S. application Ser. No. 14/253,591, filed on Apr. 15, 2014, which is a divisional of U.S. application Ser. No. 12/209,566 (now U.S. Pat. No. 8,733,553), filed Sep. 12, 2008, which is a continuation of U.S. application Ser. No. 11/223,918, filed Sep. 13, 2005, now abandoned and for which priority is claimed under 35 U.S.C. §120 and §121. This application is also based upon and claims the benefit of priority under 35 U.S.C. §119 from Japanese Patent Application No. 2005-012900, filed Jan. 20, 2005. The entire contents of each of these applications are incorporated herein by reference in their entireties.

BACKGROUND OF THE INVENTION

1. Field of the Invention

The present invention relates to a sheet processing apparatus in which a plurality of sheets of a plurality of types are loaded together, and which sorts the sheets according to sheet types and states such as unfitness degrees or orientations, and collects the sorted sheets in a plurality of cassettes.

2. Description of the Related Art

Conventionally, a bill processing apparatus as a sheet processing apparatus is an apparatus which sorts a plurality of bills of a plurality of types according to conditions such as bill type or the state of bills. Such a bill processing apparatus has a plurality of cassettes assigned in accordance with the conditions of bills (type or the state of bills). In the above bill processing apparatus, a discrimination unit discriminates the type or state of bills, and the respective bills are collected in the respective cassettes on the basis of the discrimination results.

The assignment of conditions (bill type or state) of bills to the respective cassettes in the above bill processing apparatus is preferably changed in accordance with user's demands or a plurality of bills to be processed as circumstances demand. If, for example, it is expected that a plurality of bills to be processed will include many bills of a specific bill type, the bill type of bills expected to be included in large quantity is assigned to a cassette with which an operator can easily work. This makes it possible for the operator to easily work with the cassette which is filled to capacity with a high frequency. If the sheet processing apparatus is equipped with a sealing device which seals a predetermined number of bills, the type of bills expected to be included in large quantities in a plurality of bills to be processed is assigned as a bill type for which sealing is performed by the sealing device. This makes it possible to efficiently perform processing up to the sealing process after the sorting process with respect to bills of the bill type to be processed in the greatest quantity.

In the conventional bill processing apparatuses, however, the assignment of the conditions (bill type or state) of bills to a plurality of cassettes is fixed or can be changed only by special operation. Therefore, demands have arisen for an apparatus which allows easy setup of the conditions of bills to be assigned to the respective cassettes, as circumstances require in accordance with user's demands or a plurality of bills to be processed.

BRIEF SUMMARY OF THE INVENTION

It is an object of the present invention to provide a sheet processing apparatus which can easily set conditions for sheets to be assigned to cassettes in accordance with user's demands or a plurality of sheets to be processed.

According to the present invention, there is provided a sheet processing apparatus which checks sheets and sorts the sheets for a plurality of cassettes on the basis of the check result and conditions for the sheets which are assigned to the respective cassettes, comprising a display unit which displays information indicating a condition for a sheet which is assigned to each cassette, a first selection unit which selects a cassette displayed by the display unit, a second selection unit which selects a condition for a sheet which is displayed by the display unit, and a setup unit which, when a cassette is selected by the first selection unit and a condition for a sheet is selected by the second selection unit, assigns the condition selected by the second selection unit to the cassette selected by the first selection unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The best mode for executing the present invention will be described in detail with reference to the views of the accompanying drawing.

Figure 1:
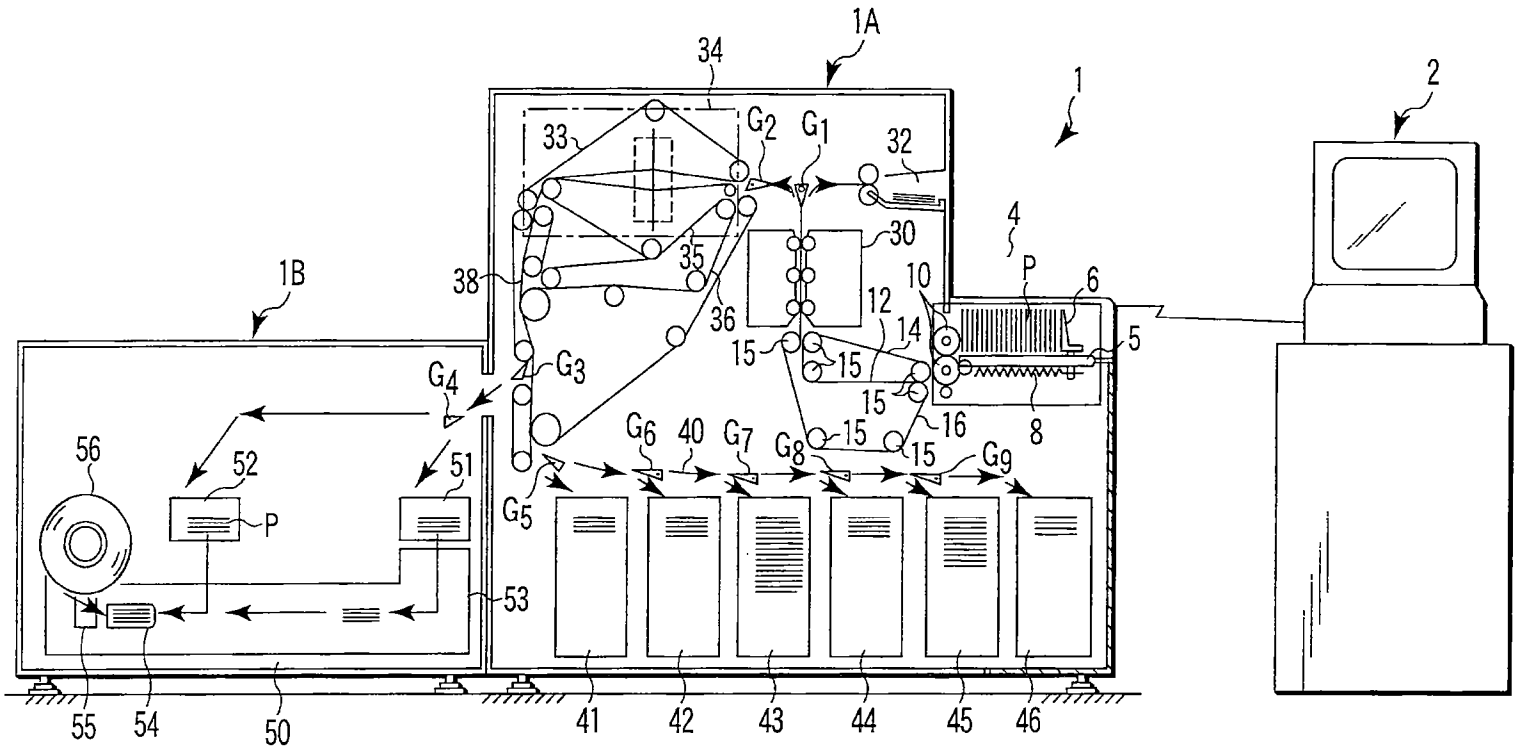
FIG. 1 is a view showing the schematic arrangement of a bill processing system (sheet processing apparatus) according to an embodiment of the present invention.

FIG. 1 shows the schematic arrangement of a bill processing system (sheet processing apparatus) according to an embodiment of the present invention.

This bill processing system comprises a bill processing apparatus body 1 and a controller 2 for operating the bill processing apparatus body 1. The bill processing apparatus body 1 controlled by the controller 2 may be a single apparatus or may include a plurality of apparatuses.

The bill processing apparatus body 1 has a sorting/collecting device 1A which sorts bills according to type or state and collects the sorted bills for each type or state, and a sealing device 1B which seals bills for every predetermined number of bills. The above bill processing apparatus body 1 is configured to allow an arbitrary number of sealing devices 1B to be connected to the single sorting/collecting device 1A.

A plurality of bills of a plurality of types are loaded altogether into the sorting/collecting device 1A. The sorting/collecting device 1A sorts the loaded bills according to the type and state of the bills loaded. The sorting/collecting device 1A conveys the sorted bills to the respective cassettes or the sealing device 1B. The sealing device 1B collects the bills supplied from the sorting/collecting device 1A into a cassette and seals the bills for every predetermined number of bills.

The controller 2 performs control on the bill processing apparatus body 1, operation setup for the bill processing apparatus body 1, management of data to be processed by the bill processing apparatus body 1, or the like. The controller 2 comprises, for example, a personal computer. The controller 2 has a display unit, operation unit, save unit, and the like which will be described later.

The internal arrangement of the bill processing apparatus body 1 will be described next.

As shown in FIG. 1, the bill processing apparatus body 1 comprises the sorting/collecting device 1A and sealing device 1B.

The sorting/collecting device 1A is provided with a loading unit 4 into which a plurality of bills P are loaded. A plurality of bills including a plurality of types are loaded altogether into the loading unit 4. Each bill P to be loaded into the loading unit 4 has a longitudinal direction and widthwise direction. Each bill is loaded into the loading unit 4 with its upper or lower end in the longitudinal direction facing downward.

The loading unit 4 has a stage 5, backup plate 6, and pickup rollers 10. A plurality of bill P are loaded onto the stage 5 with their upper or lower ends being brought into contact with the stage and aligned. The backup plate 6 vertically stands on the stage 5. The backup plate 6 moves toward the pickup rollers 10 (to the left in FIG. 1) along the stage 5. The pickup rollers 10 comprise a pair of rollers. The pickup rollers 10 rotate in predetermined directions to sequentially pick up the bill P located on the left end on the stage 5 in FIG. 1. The plurality of bills P loaded into the loading unit 4 are, therefore, moved to the left along the stage 5 by the backup plate 6 and pressed against the pickup rollers 10 (pickup portion).

A conveying path 12 is provided in the subsequent stage of the pickup rollers. The conveying path 12 comprises a plurality of rollers 15 and conveying belts 14 and 16. The bill P is conveyed in the conveying path 12 by the conveying belts 14 and 16 driven by the plurality of rollers 15. The bills P picked up by the pickup rollers 10 are sequentially supplied into the conveying path 12. For example, the pickup rollers 10 supply the bill P to the conveying path 12 in the widthwise direction with the upper or lower end taking the lead. In addition, the bills P supplied onto the conveying path 12 by the pickup rollers 10 have their obverse and reverse surfaces randomly facing up and down. In the arrangement example shown in FIG. 1, the pickup direction of the bill P picked up from the loading unit 4 faces down.

A detection unit 30 is provided in the conveying path 12 extending in the subsequent stage of the pickup rollers 10. The detection unit 30 detects characteristics of the bill P, e.g., the bill type, obverse/reverse (front surface/back surface) side, top/rear end, soil, or damage. The detection unit 30 comprises various types of sensors. The various types of sensors provided for the detection unit 30 read various kinds of information from the bill P conveyed in the conveying path 12. The detection unit 30 is provided with, for example, an image sensor which reads an image on the observer surface of the bill P, a sensor which detects the thickness of the bill P, and a sensor which detects a magnetic member contained in the bill P. A determination unit (to be described later) determines the above characteristics of the bill P on the basis of the information read by the respective sensors of the detection unit 30.

In the sorting/collecting device 1A shown in FIG. 1, a plurality of bills P with their obverse and reverse surfaces and front and rear ends been randomly directed are loaded into the loading unit 4. Consequently, the respective bills P pass through the detection unit 30 with their observer and reverse surfaces and front and rear ends being randomly directed. In this case, there are four types of directions associated with the observe and reverse surfaces and front and rear ends of the bill P passing through the detection unit 30. In the following description, the bill P which is picked up with the obverse surface facing up and the upper end facing forward in the conveying direction will be referred to as a front/front (FF) bill; the bill P which is picked up with the obverse surface facing up and the lower end facing forward in the conveying direction, a front/rear (FR) bill; the bill P which is picked up with the reverse surface facing up and the upper end facing forward in the conveying direction, a back/front (BF) bill; and the bill P which is picked up with the reverse surface facing up and the lower end facing forward in the conveying direction, a back/rear (BR) bill. That is, the bill P passing through the detection unit 30 is conveyed in one of these four types of postures in conveyance.

A plurality of gates G1 to G9 for selectively switching the conveying direction of the bill P on the basis of the detection results obtained by the detection unit 30 are provided on the conveying path 12 extending in the subsequent stage of the detection unit 30.

First of all, the gate G1 sorts the bills P into those which can be processed in the subsequent stage and those which are to be rejected. For example, a bill for which the detection unit 30 determines that processing in the subsequent stage cannot be performed is conveyed to a reject box 32 (to the right in FIG. 1) through the gate G1. Bills for which processing in the subsequent stage cannot be performed include, for example, two bills which are determined as bills picked up simultaneously, a bill determined as the one which is skewed beyond a predetermined level, and bills which are not determined as fit bills which can be re-circulated, such as unfit bills and counterfeit bills (not limited to bills). That is, an operator can take out the bills P collected in the reject box 32.

On the other hand, the bill P determined by the detection unit 30 as the one for which processing in the subsequent stage can be performed is conveyed to the gate G2 (to the left in FIG. 1) through the gate G1. The gate G2 distributes the bill P in accordance with the obverse/reverse surface state. The conveying path on the downstream side of the gate G2 branches in two directions. That is, the gate G2 selectively switches the conveying direction of the bill P to the two directions in accordance with the obverse/reverse surface state.

A reversing mechanism 34 (reversing unit) which reverses the obverse and reverse surfaces of the bill P is provided on one conveying path which branches off on the downstream side of the gate G2. The other conveying path 36 which branches off on the downstream side of the gate G2 is a conveying path through which the bill P is simply made to pass without changing the orientations of the obverse and reverse surfaces. That is, the obverse and reverse surfaces of the bills P can be made to face the same directions in the subsequent stage of the gate G2.

The reversing mechanism 34 comprises of two conveyor belts 33 and 35. The conveyor belts 33 and 35 are rotated through 180° from the inlet to outlet to form a twisted conveying path. Therefore, the bill P distributed to the reversing mechanism 34 by the gate G2 is reversed. For example, an FF bill is reversed by the reversing mechanism 34 into a BF bill with its reverse surface facing up.

Both the bill P whose obverse and reverse surfaces have been reversed upon passing through the reversing mechanism 34 and the bill P which has passed through the conveying path 36 without passing through the reversing mechanism 34 are fed to the gate G3 through a merging portion 38.

The processing time (conveying time) required for the bill P to arrive from the gate G2 to the merging portion 38 through the reversing mechanism 34 is set to be equal to the conveying time required for the bill P to arrive from the gate G2 to the merging portion 38 through the conveying path 36. This makes it possible for the bill P conveyed through the reversing mechanism 34 and the bill P conveyed through the conveying path 36 to pass through the merging portion 38 at the same timing.

The gate G3 distributes the bill P passing through the merging portion 38. The conveying path on the downstream side of the gate G3 branches in two directions. The gate G3 selectively switches the conveying direction of the bill P to the two directions in accordance with the type of bill P (or state).

One conveying path which branches off on the downstream side of the gate G3 is a conveying path for conveying the bill P to the sealing device 1B. The other conveying path (horizontal conveying path) 40 which branches off on the downstream side of the gate G3 is a conveying path for collecting the bills P in cassettes 41 to 46 in the sorting/collecting device 1A. Each of the cassettes 41 to 46 is provided with a sensor which detects the presence/absence of a bill.

The horizontal conveying path 40 which branches to the right in FIG. 1 by the gate G3 forms a conveying path extending in an almost horizontal direction above the plurality of cassettes 41 to 46. The five gates G5 and G9, each for distributing and collecting the bill P in a corresponding one of the six cassettes 41 to 46, are provided on the horizontal conveying path 40.

The bill P selectively distributed by the gate G5 on the most upstream side of the horizontal conveying path 40 is collected in the cassette 41. The bill P selectively distributed by the gate G6 is collected in the cassette 42. The bill P selectively distributed by the gate G7 is collected in the cassette 43. The bill P selectively distributed by the gate G8 is collected in the cassette 44. The bill P selectively distributed by the gate G9 is collected in the cassette 45 or 46.

As shown in FIG. 1, the sealing device 1B has a cassette 51, cassette 52, supply unit 53, sealing mechanism 54, printing mechanism 55, and strap supply unit 56. The cassettes 51 and 52 collect the bills P fed through the gate G4. Each of the cassettes 51 and 52 is provided with a sensor which detects the presence/absence of a bill.

The supply unit 53 supplies a predetermined number (e.g., 100) of bills P collected in the cassette 51 or 52 to the sealing mechanism 54. The sealing mechanism 54 seals the predetermined number (e.g., 100) of bills P supply by the supply unit 53 and collected in the cassette 51 or 52 with a strap. The printing mechanism 55 prints desired print data on a strap used by the sealing mechanism 54. The strap supply unit 56 supplies a strap to be used by the sealing mechanism 54.

The bills P are supplied to the sealing device 1B by the conveying path which branches to the left in FIG. 1 by the gate G3 of the sorting/collecting device 1A. The conveying directions of the bills P supplied from the sorting/collecting device 1A are selectively switched to the two directions by the gate G4 in the sealing device 1B. The bills P which are switched and conveyed by the gate G4 are selectively collected in the cassette 51 or 52 in the sealing device 1B.

The bills P collected in the cassette 51 or 52 through the gate G4 are fed to the sealing mechanism 54 by the supply unit 53. The sealing mechanism 54 seals the predetermined number of bills P supplied by the supply unit 53 with the strap supplied from the strap supply unit 56. Bundles of bills P obtained by sealing the bills P for every predetermined number of bills are unloaded from the apparatus through a conveyer (not shown).

Note that the sorting/collecting device 1A is configured to supply bills of a specific bill type to the sealing device 1B on the basis of the settings to be described later. The sealing device 1B therefore seals bills of the specific bill type supplied from the sorting/collecting device 1A. Bills P of bill types other than those of specific bill type to be sealed by the sealing device 1B are collected in one of the cassettes 41 to 46 in the sorting/collecting device 1A.

The control system of the sheet processing system will be described next.

Figure 2:
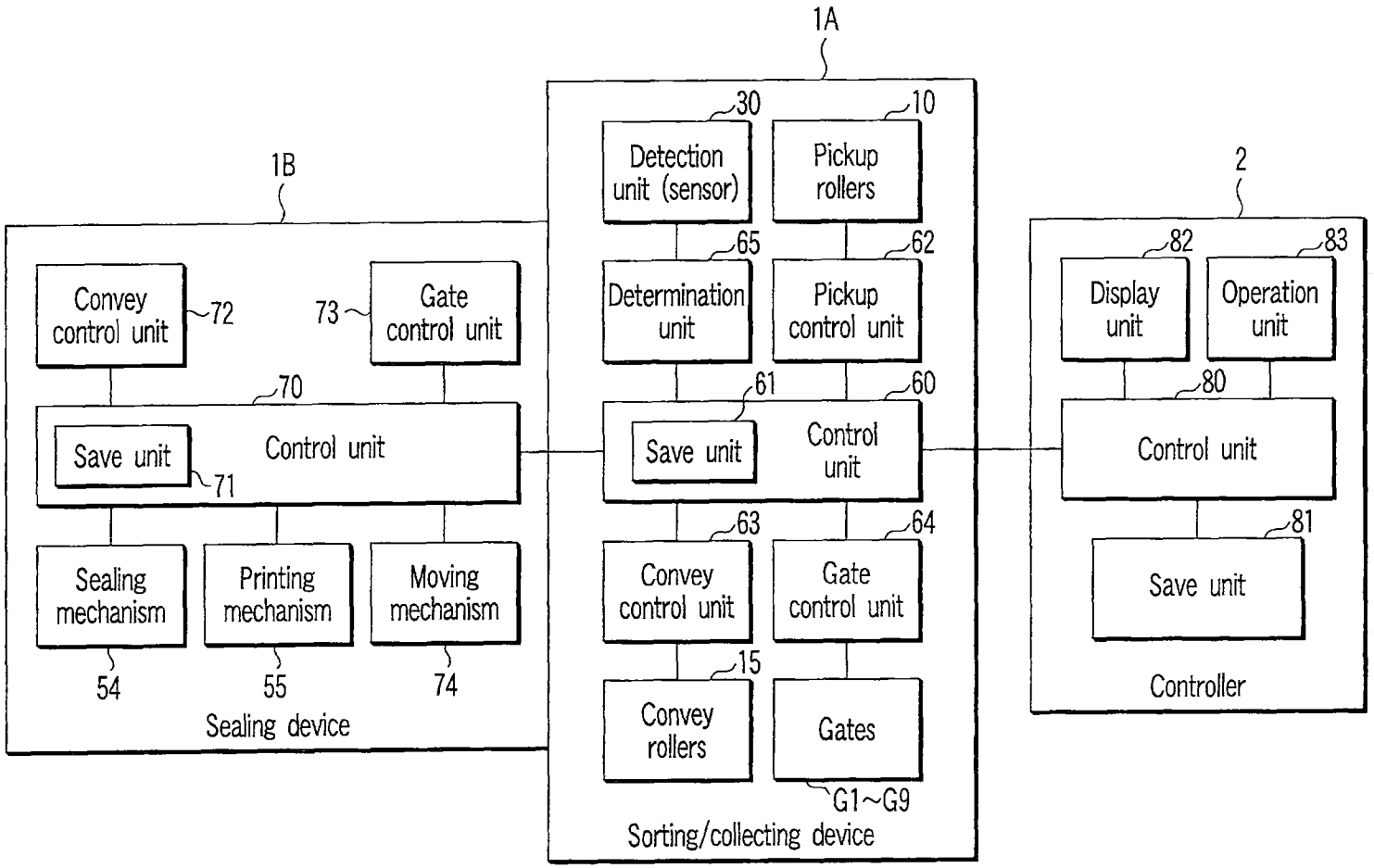
FIG. 2 is a block diagram of the control system of the bill processing system.

FIG. 2 is a block diagram showing the control system of the above bill processing system.

As shown in FIG. 2, the control system of the sorting/collecting device 1A of the bill processing apparatus body 1 comprises a control unit 60, save unit 61, pickup control unit 62, conveying control unit 63, gate control unit 64, determination unit 65, and the like.

The control unit 60 controls the overall operation of the sorting/collecting device 1A in accordance with an operation program set in advance. The operation program to be executed by the control unit 60 is saved in the save unit 61. The save unit 61 is also used to save data. For example, the save unit 61 is provided with count tables for counting the numbers of bills collected in the cassettes 41 to 46 and cassettes 51 and 52 of the sealing device 1B.

The pickup control unit 62 drives the pickup rollers 10 under the control of the control unit 60. The conveying control unit 63 drives the rollers 15, etc., under the control of the control unit 60. The gate control unit 64 drives the gates G1 to G3 and G5 to G9 under the control of the control unit 60.

The determination unit 65 determines the state of the bill P on the basis of detection results from the detection unit 30. The determination unit 65 determines the characteristics of the bill P by comparing the information read by the each sensor with reference information. The determination unit 65 outputs the determination result based on the detection results from the detection unit 30 to the control unit 60.

For example, the determination unit 65 determines the bill type of the bill P and also determines whether the bill P is reversed or turned upside down. The determination unit 65 determines whether the bill P is a fit or unfit bill. A fit bill is a bill that can be re-circulated. An unfit bill is a bill that cannot be re-circulated. That is, whether a given bill is a fit or unfit bill is determined on the basis of the state (quality) of the bill. The determination unit 65 determines whether a given bill is a fit or unfit bill, on the basis of, for example, how the bill is soiled, ripped, and creased, the paper quality of the bill, and how much the ripped bill has been repaired with tape or the like.

As shown in FIG. 2, the control system of the sealing device 1B of the bill processing apparatus body 1 comprises a control unit 70, a save unit 71, a conveying control unit 72, a gate control unit 73, a moving mechanism 74, the sealing mechanism 54, the printing mechanism 55, and the like.

The control unit 70 controls the overall operation of the sealing device 1B in accordance with an operation program set in advance. The operation program to be executed by the control unit 70 is saved in the save unit 71. The conveying control unit 72 drives the conveying rollers under the control of the control unit 70. The gate control unit 73 drives the gate G4 under the control of the control unit 60. The moving mechanism 74 moves (conveys) a predetermined number of sheets collected in the cassette 51 or 52 under the control of the control unit 70.

As shown in FIG. 2, the control system of the controller 2 comprises a control unit 80, save unit 81, display unit 82, operation unit 83, and the like.

The control unit 80 controls the overall operation of the controller 2 in accordance with an operation program set in advance. For example, the control unit 80 has a function of performing various types of operation setups for the sorting/collecting device 1A on the basis of operation instructions from the operator. The operation program to be executed by the control unit 80 is saved in the save unit 81. In addition, setting information and the like for the cassettes 41 to 46 of the sorting/collecting device 1A and the cassettes 51 and 52 of the sealing device 1B are stored in the save unit 81 in correspondence with a "preset" (setup name) to be described later.

The display unit 82 displays operation guidance and the like for the operator on the basis of display control by the control unit 80. The operation unit 83 is used by the operator to input operation instructions. The display unit 82 comprises a display device and the like. The operation unit 83 comprises an input device such as a keyboard or mouse and the like. The display unit 82 and operation unit 83 may comprise a display device incorporating a touch panel. Furthermore, the display unit 82 and operation unit 83 may comprise a display device incorporating a touch panel and an input device such as a keyboard.

Setup operation by the controller 2 for the cassettes 41 to 46, 51, and 52 of the bill processing apparatus body 1 will be described next.

Assume that the display unit 82 and operation unit 83 comprise a display device incorporating a touch panel, and setup operation for the cassettes 41 to 46, 51, and 52 are performed by a supervisor.

Figure 3:
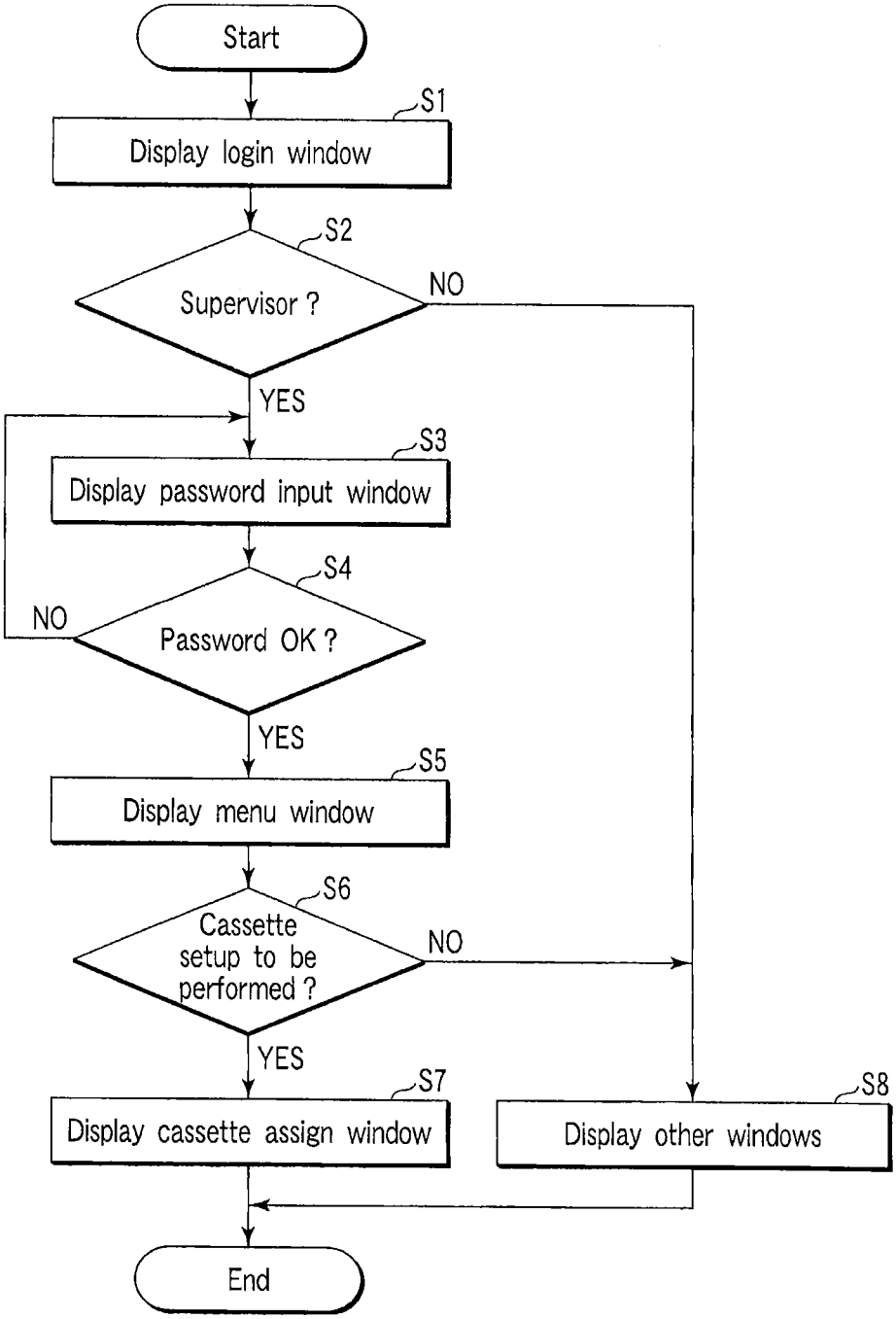
FIG. 3 is a flowchart for explaining the operation of displaying a cassette setup window by a control device.
Figure 4:
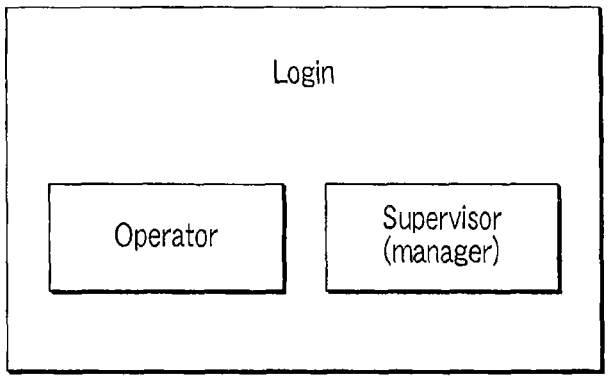
FIG. 4 is a view showing a display example of a login window.
Figure 5:
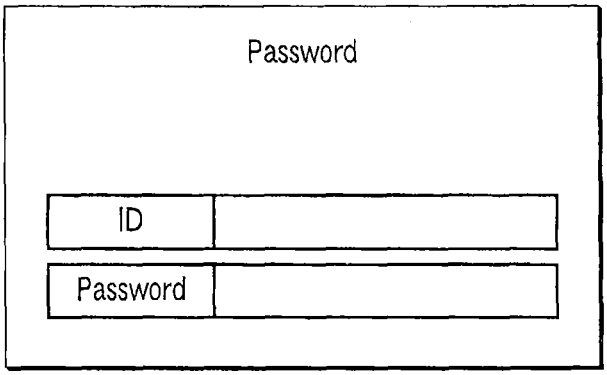
FIG. 5 is a view showing a display example of a supervisor authentication window.
Figure 6:
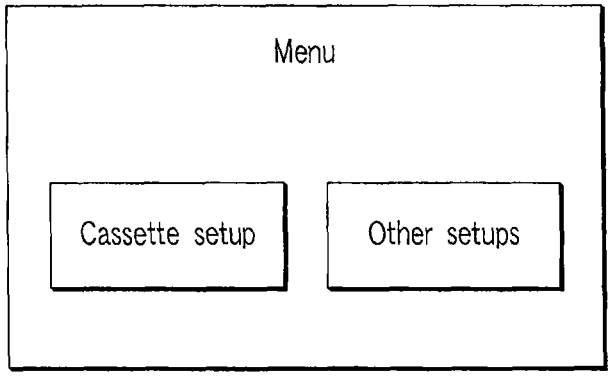
FIG. 6 is a view showing a display example of a menu window for the supervisor.

FIG. 3 is a flowchart for explaining how the controller 2 displays a cassette setup window. FIG. 4 is a view showing a display example of a login window. FIG. 5 is a view showing a display example of a supervisor authentication window. FIG. 6 is a view showing a display example of a menu window for a supervisor.

The control unit 80 displays a login window on the display unit 82 (step S1). For example, as shown in FIG. 4, the login window displays selection buttons for a supervisor (who has the right to change settings) and an operator (who no right of supervision). When the button for selecting the supervision is operated on such a login window (YES in step S2), the control unit 80 displays an authentication window for the supervisor on the display unit 82 (step S3). For example, as shown in FIG. 5, the supervisor authentication window displays an input window for the ID information and password of the supervisor.

When authentication information (ID information and password) is input in this window, the control unit 80 determines whether or not the input authentication information is correct (step S4). If it is determined by this determination that the input authentication information is correct (YES in step S4), the control unit 80 displays a menu window for the supervisor on the display unit 82 (step S5).

As shown in FIG. 6, the menu window for the supervisor displays at least a button for selecting cassette setup (cassette assign). When the button for selecting cassette setup is input on this menu window for the supervisor (YES in step S6), the control unit 80 displays a cassette assign window (to be described later) on the display unit 82 (step S7). In this cassette assign window, each cassette in the bill processing apparatus body 1 is set up (conditions for bills to be assigned to each cassette are set).

As described above, only a supervisor who is authenticated by authentication information such as a password can set up each cassette or set a fitness level for sorting fit and unfit bills. That is, in the above bill processing system, bills are sorted according to the setting contents set by the supervisor. This can prevent a general operator (who has no right of supervision) from changing the settings for each cassette or the fitness level setting.

A setup window for the cassettes 41 to 46, 51, and 52 will be described next.

Figure 7:
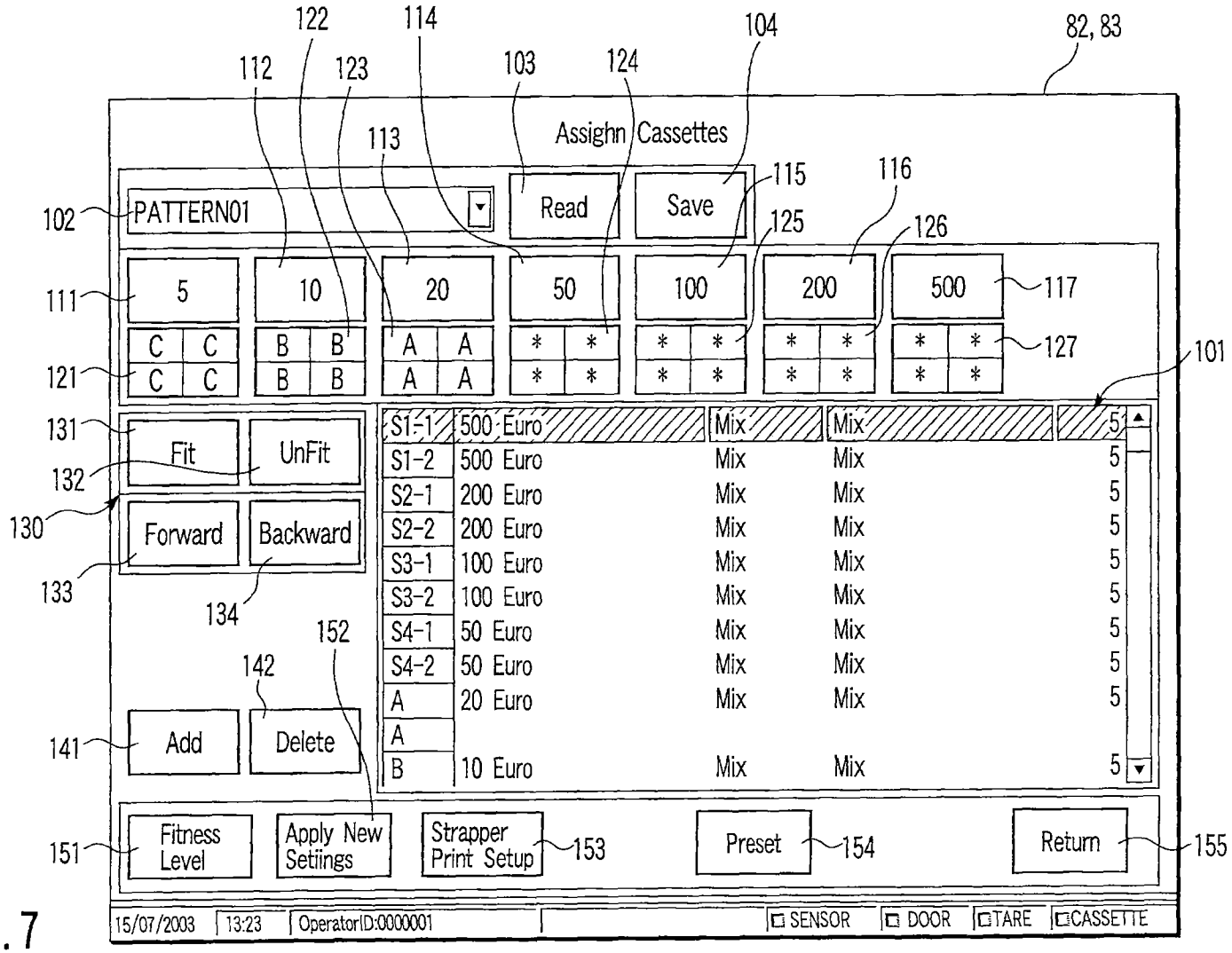
FIG. 7 is a view showing a display example of a setup window (cassette assign window) for the respective cassettes.

FIG. 7 shows a display example of a setup window (cassette assign window) for each cassette.

According to the display example shown in FIG. 7, the cassette assign window comprises a setup state display window 101, setup name display window 102, read button 103, save button 104, bill type designation buttons 111 to 117, state display icons 121 to 127, state designation button 130 (131 to 134), add button 141, delete button 142, fitness level setup button 151, apply button 152, strapper print setup button 153, preset button 154, return button 155, and the like.

The display window 101 is a display area which displays the setting information of each cassette. The display window 101 displays a list of bill types, conditions, and the like assigned to the cassettes 41 to 46, 51, and 52. According to the display example shown in FIG. 7, information indicating each cassette is displayed in a left end field on the display window 101. For example, "S1-1" indicates the cassette 51 of the sealing device 1B, and "S1-2" indicates the cassette 52 of the sealing device 1B. In addition, "S2-1" to "S4-2" respectively indicate the second and subsequent cassettes of the sealing device.

FIG. 1 shows the arrangement in which one sealing device is connected to the sorting/collecting device 1A. As described above, however, the sheet processing system allows a plurality of sealing devices to be connected to the single sorting/collecting device 1A. When a plurality of sealing devices are connected to the single sorting/collecting device 1A, "S2-1" to "S4-2" indicate the cassettes of the second and subsequent sealing devices.

In the example of the display window 101 shown in FIG. 7, "A" in the left end field indicates the cassette 41 in the sorting/collecting device 1A, and "B" indicates the cassette 42 in the sorting/collecting device 1A. In the display example shown in FIG. 7, two "A" fields are provided. This indicates that two types of bills can be assigned to the cassette 41. In this manner, a plurality of types of bills can be assigned to one cassette.

Each second field from the left in the display window 101 in FIG. 7 displays information indicating a bill type assigned to a corresponding cassette. For example, in the example of the display window 101 shown in FIG. 7, "500 Euro" is assigned to the cassette indicted by "S1-1" (i.e., the cassette 51) and the cassette indicated by "S1-2" (i.e., the cassette 52), "20 Euro" is assigned to the cassette indicated by "A" (i.e., the cassette 41), and "10 Euro" is assigned to the cassette indicated by "B" (i.e., the cassette 42).

Each third field from the left in the example of the display window 101 shown in FIG. 7 displays information indicating a bill state as the first condition for the bill. This field displays information indicating fit bills (Fit), unfit bills (Unfit) or a mix of fit and unfit bills (Mix) as the first condition for bills.

For example, in the case of the display window 101 shown in FIG. 7, "500 Euro" with "Mix" as the first condition is assigned to the cassette indicated by "S1-1" (i.e., the cassette 51) and the cassette indicated by "S1-2" (i.e., the cassette 52). In addition, "20 Euro" with "mix of fit and unfit bills (Mix)" as the first condition is assigned to the cassette indicated by "A" (i.e., the cassette 41), and "10 Euro" with "mix of fit and unfit bills (Mix)" as the first condition is assigned to the cassette indicated by "B" (i.e., the cassette 42).

Each fourth field from the left in the display window 101 in FIG. 7 displays information indicating a bill state as the second condition for the bills. This field displays information, as the second condition for bills, indicating whether bills (collected in the cassette) are in the forward orientation (Forward), the backward orientation (Backward), or a mix of forward and backward orientations (Mix). Note that if the sorting/collecting device 1A is provided with a mechanism for making the orientations of bills consistent, such display fields indicating the orientations of bills (when collected in the cassettes) are omitted.

In the example of the display window 101 shown in FIG. 7, "500 Euro" with the first condition "mix of fit and unfit bills (Mix)" and the second condition "mix of forward and backward orientations (Mix)" is assigned to the cassette indicated by "S1-1" (i.e., the cassette 51) and the cassette indicated by "S1-2" (the cassette 52). In addition, "20 Euro" with the first condition "mix of fit and unfit bills (Mix)" and the second condition "mix of forward and backward orientations (Mix)" is assigned to the cassette indicated by "A" (i.e., the cassette 41), and "10 Euro" with the first condition "mix of fit and unfit bills (Mix)" and the second condition "mix of forward and backward orientations (Mix)" is assigned to the cassette indicated by "B" (i.e., the cassette 42).

Each fifth (right end) field from the left in the display window 101 in FIG. 7 displays information indicating the fitness level of the type of bill assigned to a corresponding cassette. For example, in the example of the display window 101 shown in FIG. 7, level "5" is set as a fitness level for each bill type assigned to each cassette.

The display window 102 is a display area for displaying a setup name called a "preset". The "preset" is the setup name of all the setting contents like those shown in FIG. 7. The "preset" can be changed by, for example, clicking the right end of the display window 102.

The read button 103 is a button for instructing to read the setting content of the "preset" displayed on the display window 102. The save button 104 is a button for instructing saving of the contents set by the respective types of buttons in FIG. 7 with a "preset" (setup name) displayed on the display window 102.

The bill type designation buttons 111 to 117 are buttons for designating the types of bills. In the example shown in FIG. 7, the bill type designation button 111 is a button for designating "5 Euro"; the bill type designation button 112, a button for designating "10 Euro"; the bill type designation button 113, a button for designating "20 Euro"; the bill type designation button 114, a button for designating "50 Euro"; the bill type designation button 115, a button for designating "100 Euro", the bill type designation button 116, a button for designating "200 Euro"; and the bill type designation button 117, a button for designating "500 Euro".

When, for example, "500 Euro" is to be assigned to "S1-1", the bill type designation button 117 is selected while the field of "S1-1" is in the selected state (highlighted state), as shown in FIG. 7. With this operation, "500 Euro" bills are assigned to the cassette indicated by "S1-1".

The state display icons 121 to 127 display how bills are assigned to the cassettes 41 to 46 in the sorting/collecting device 1A in accordance with the type and state of the bills. In the example shown in FIG. 7, the display icon 121 indicates the assignment of "5 Euro"; the display icon 122, the assignment of "10 Euro"; the display icon 123, the assignment of "20 Euro"; the display icon 124, the assignment of "50 Euro"; the display icon 125, the assignment of "100 Euro"; the display icon 126, the assignment of "200 Euro"; and the display icon 127, the assignment of "500 Euro".

Figure 8:
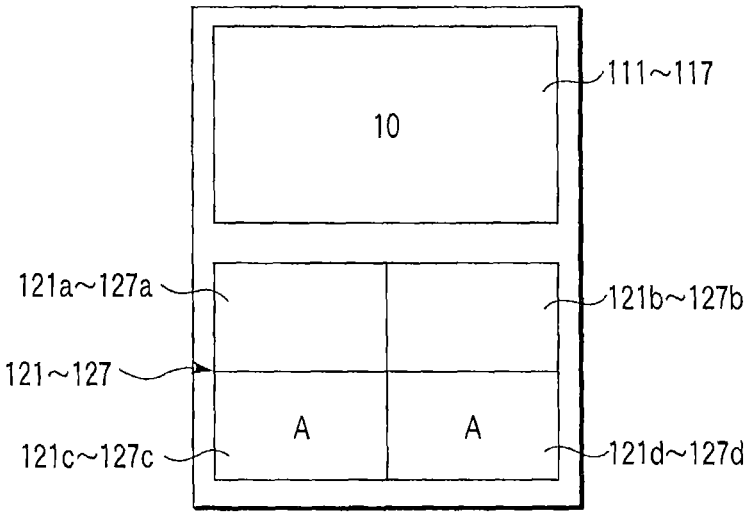
FIG. 8 is a view showing examples of bill type designation buttons and assigned state display keys.
Figure 9:
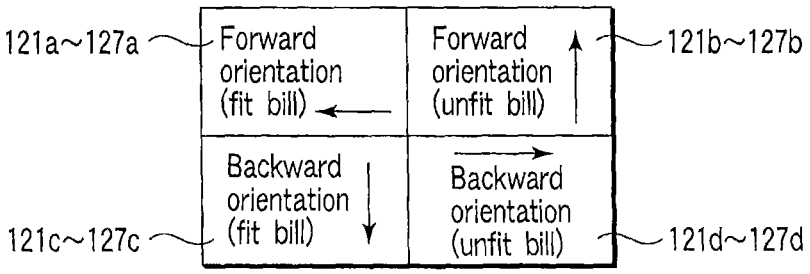
FIG. 9 is a view for explaining information represented by each assigned state display key.

For example, FIG. 8 shows examples of the bill type designation buttons 111 to 117 and state display icons 121 to 127. FIG. 9 is a view for explaining the information represented by each of the state display icons 121 to 127. As shown in FIGS. 8 and 9, the state display icons 121 to 127 respectively comprise icons 121*a* to 127*a* indicating how fit bills in the forward orientation (fit and forward) are assigned, icons 121*b* to 127*b* indicating how unfit bills in the forward orientation (unfit and forward) are assigned, icons 121*c* to 127*c* indicating how fit bills in the backward orientation (fit and backward) are assigned, and icons 121*d* to 127*d* indicating how unfit bills in the backward orientation (unfit and backward) are assigned. Therefore, the state display icons 121 to 127 indicate the cassettes 41 to 46 to which corresponding bill types are assigned under the four conditions.

The state designation button 130 comprises the fit bill button 131, unfit bill button 132, forward orientation button 133, and backward orientation button 134. The fit bill button 131 is a button for designating a fit bill (fit) as a condition for a bill. The unfit bill button 132 is a button for designating an unfit bill (unfit) as a condition for a bill. The forward orientation button 133 is a button for designating a forward orientation (forward) as a condition for a bill. The backward orientation button 134 is a button for designating a backward orientation (backward) as a condition for a bill.

The add button 141 is a button for instructing adding of a condition (bill type or bill state) for bills assigned to a selected cassette. The delete button 142 is a button for instructing deleting of a condition (bill type or bill state) for bills assigned to a selected cassette.

The fitness level setup button 151 is a button for instructing to change the threshold for determining whether each bill is a fit or unfit bill. The apply button 152 is a button for instructing to apply the setting contents displayed on the window. The strapper print setup button 153 is a button for instructing to set contents to be printed on a strap with which a predetermined number of bills are bundled by the sealing device 1B. The preset button 154 is a button for instructing setting of a setup name as a "preset". The return button 155 is a button for instructing returning to previous operation.

A setup sequence based on the above cassette assignment window will be described next.

Figure 10:
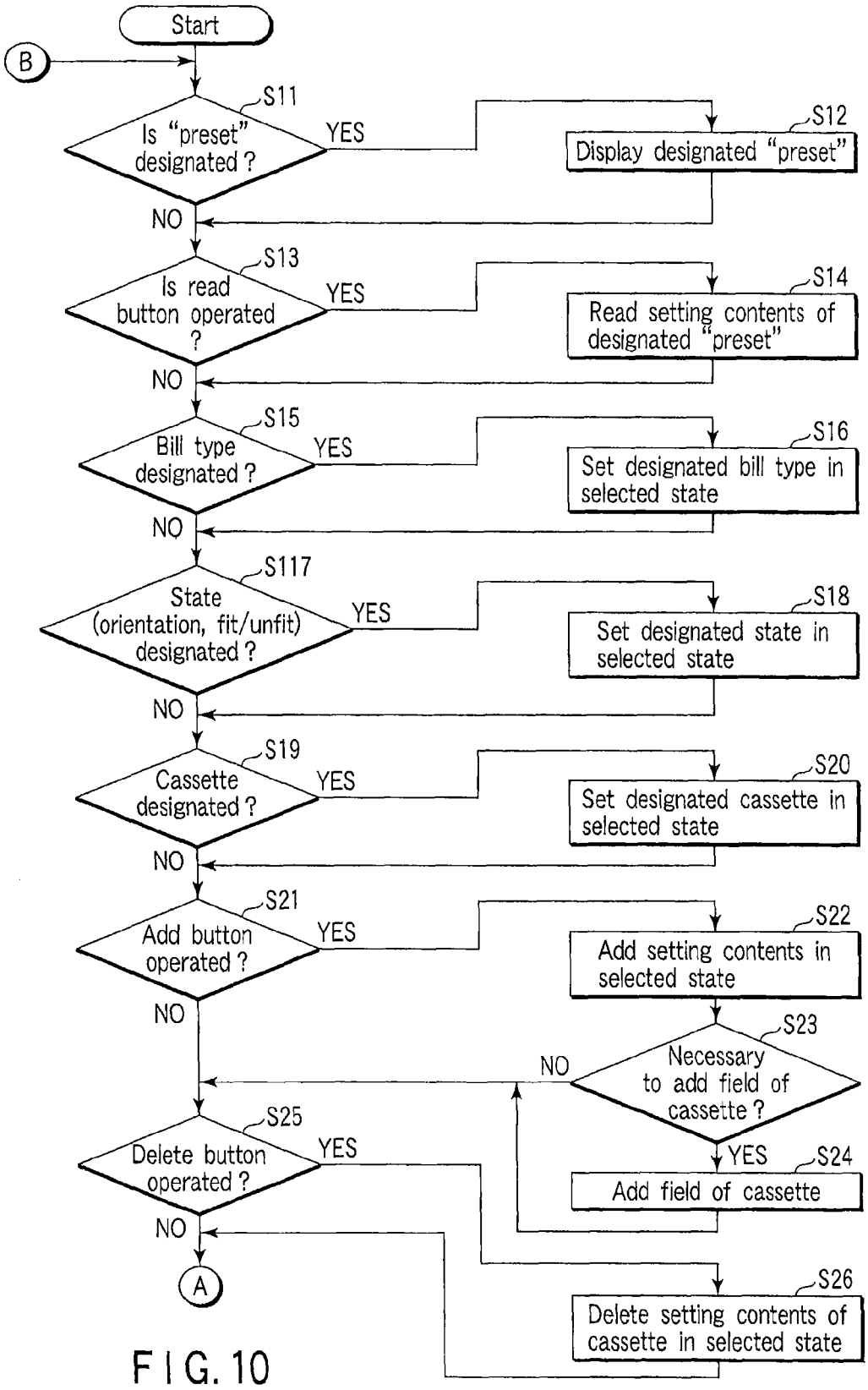
FIG. 10 is a flowchart for explaining various types of setup operations using the cassette assign window.
Figure 11:
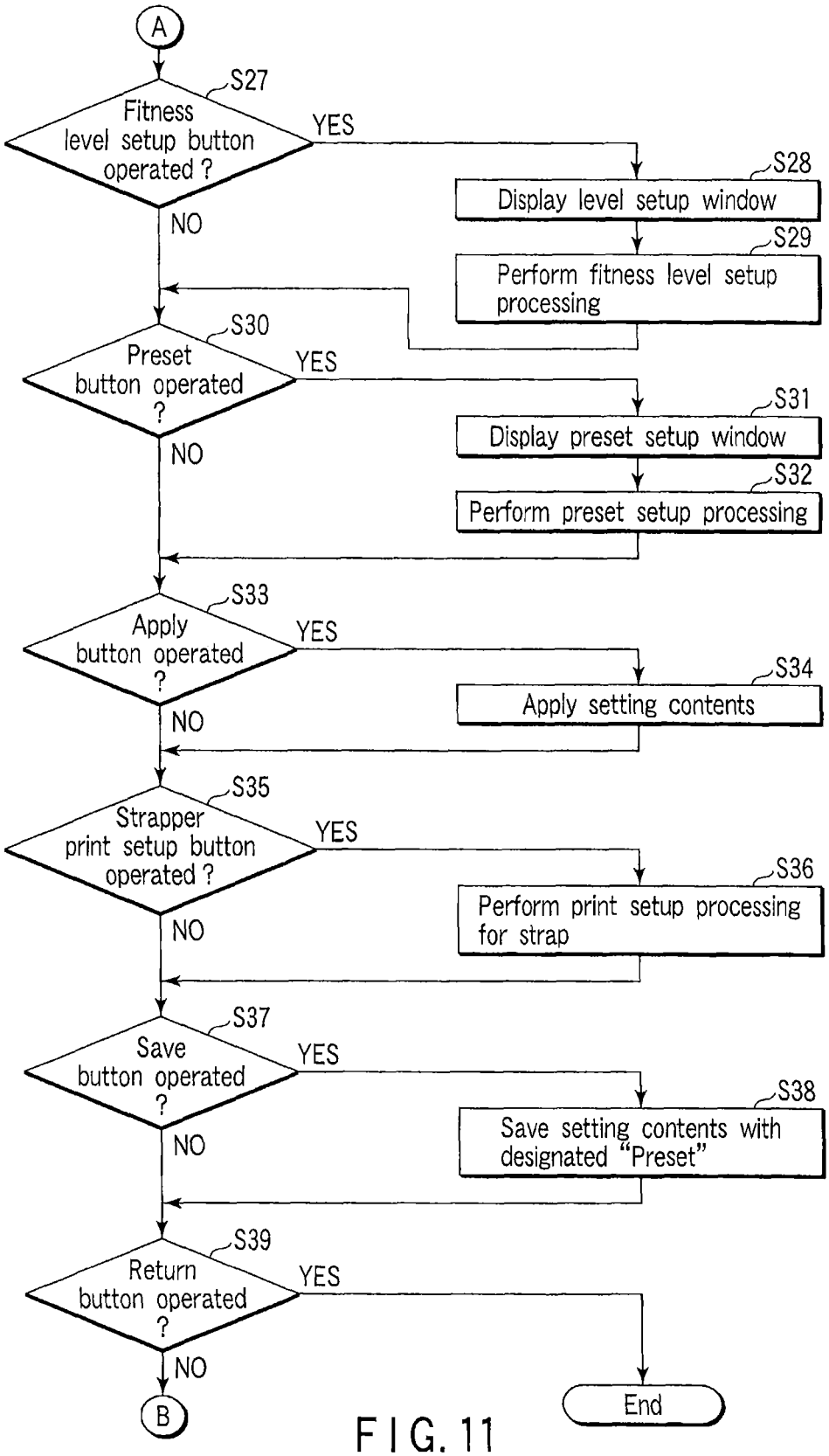
FIG. 11 is a flowchart for explaining various types of setup operations using the cassette assign window.

FIGS. 10 and 11 are flowcharts for explaining various types of setup operations using the cassette assignment window shown in FIG. 7. Assume that the display unit 82 and operation unit 83 comprise a display device incorporating a touch panel. Assume therefore that the various types of buttons shown in FIG. 7 are displayed on the screen of the display device in a state wherein the supervisor can input instructions using the touch panel.

The supervisor designates a "preset" (setup name) for setup with the display window 102. When the "preset" (setup name) is designated (YES in step S11), the control unit 80 displays the designated setup name called a "preset" in the display window 102 (step S12). In this state, when the read button 103 is operated (YES in step S13), the control unit 80 reads the setting contents saved in the save unit 81 in accordance with the "preset" displayed in the display window 102 (step S14).

The setting contents of the designated "preset" which are read in this manner are displayed in the cassette assignment window shown in FIG. 7. If the "preset" is not designated and the read button 103 is not operated, the control unit 80 reads the setting contents of the "preset" as default settings. In this case, the setting contents of the "preset" as the default settings are displayed as a cassette assignment window on the display unit 82.

When the setting contents of the "preset" are read, the supervisor makes various settings by using the various types of buttons and the like shown in FIG. 7. When, for example, a bill type is to be designated, the supervisor touches one of the bill type designation buttons 111 to 117 which corresponds to the desired bill type. For example, every time each of the bill type designation buttons 111 to 117 is touched, the selected state and unselected state are switched. When the supervisor touches any one of the bill type designation buttons 111 to 117 which corresponds to the desired bill type (YES in step S15), the control unit 80 sets the bill type corresponding to one of the bill type designation buttons 111 to 117 which is touched by the supervisor in the selected or unselected state (step S16).

When a bill state is to be designated, the supervisor designates a desired state by selectively touching the fit bill button 131, unfit bill button 132, forward orientation button 133, and backward orientation button 134 of the state designation button 130. Every time the fit bill button 131, unfit bill button 132, forward orientation button 133, or backward orientation button 134 is touched, the selected and unselected states are switched. When the supervisor selectively selects the fit bill button 131, unfit bill button 132, forward orientation button 133, or backward orientation button 134 (YES in step S17), the control unit 80 sets one of the fit bill button 131, unfit bill button 132, forward orientation button 133, and backward orientation button 134 which is touched by the supervisor in the selected or unselected state (step S18).

When a cassette is to be designated, the supervisor touches a display field corresponding to a desired cassette in the display window 101. Every time the display field for each cassette in the display window 101 is touched, the highlighted state (selected state) and unhighlighted (unselected state) are switched. When the supervisor touches the display field for the desired cassette (YES in step S19), the control unit 80 sets the cassette corresponding to the display field touched by the supervisor in the selected or unselected state (step S20).

When a bill type (one of the bill type designation buttons), a bill state (one of the state designation buttons), and a cassette (one of the display fields for the respective cassettes) are selected, the control unit 80 makes the input to the add button 141 valid. That is, upon determining that a cassette, a bill type, and a state are selected, the control unit 80 accepts the input to the add button 141. On the other hand, upon determining that any one of a cassette, a bill type, and a state is not selected, the control unit 80 makes the input to the add button 141 invalid.

When the supervisor touches the add button 141 while a cassette (one of the display fields for the respective cassettes), a bill type (one of the bill type designation buttons), and a bill state (one of the state designation buttons) are selected (YES in step S21), the control unit 80 displays information indicating the bill type selected by one of the bill type designation buttons 111 to 117 and information indicating the state selected by the state designation button 130 in the display field for the cassette in the selected state in the display window 101 (step S22).

This means that the bill type selected by one of the bill type designation buttons 111 to 117 and the state selected by the state designation button 130 are assigned to the cassette in the selected display field in the display window 101. That is, when the add button 141 is operated, the control unit 80 adds, to the cassette in the selected state in the display window 101, the bill type and the bill state as conditions for bills to be collected.

The control unit 80 also determines whether or not to add a new display field to the cassette to which the conditions for bills to be collected are added in step S22 (step S23). The newly added display field for the cassette is to set another condition for the cassette to which the conditions for bills to be collected are added in step S22. Assume that a plurality of conditions (bill type and state) can be set for each of the cassettes 41 to 46 in the sorting/collecting device 1A. In this case, the control unit 80 determines whether or not the cassette to which setting contents are added (or changed) in step S22 is one of the cassettes in the sorting/collecting device 1A, thereby determining whether or not to add the new display field.

Upon determining that the new display field is to be added to the cassette to which the conditions for bills to be collected are added in step S22 (YES in step S23), the control unit 80 adds the new display field for the cassette. The display field to be newly added is, for example, displayed (inserted) immediately below the display field for the cassette for which the conditions for bills to be collected are displayed in step S22 (step S24).

When the supervisor touches the delete button 142 while a cassette (one of the display fields for the respective cassettes) is selected (YES in step S25), the control unit 80 clears the information indicating the bill type and the information indicating the bill state which are displayed in the display field of the cassette in the selected state in the display window 101 (step S26). This means that the setting contents for the cassette in the selected display field in the display window 101 are deleted.

When the supervisor touches the fitness level setup button 151 (YES in step S27), the control unit 80 displays a fitness level setup window for changing the threshold (fitness level) for determining whether a bill is a fit or unfit bill (step S28). In accordance with information designated by the supervisor in this fitness level setup window, the control unit 80 performs setup processing for a threshold (fitness level) for determining whether a bill is a fit or unfit bill (step S29). The fitness level setup window and fitness level setup processing will be described in detail later.

When the supervisor touches the preset button 154 (YES in step S30), the control unit 80 displays a preset setup window for setting a setup name (title) for the saving of setting contents as a "preset" (step S31). In accordance with the information designated by the supervisor in this preset setup window, the control unit 80 performs setup processing for a "preset" for saving setting contents (step S32). The preset setup window and preset setup processing will be described in detail later.

When the supervisor touches the apply button 152 (YES in step S33), the control unit 80 performs processing of applying the setting contents displayed in the window as new setting contents (step S34).

When the supervisor touches the strapper print setup button 153 (YES in step S35), the control unit 80 displays a strapper print setup window for setting contents to be printed on a strap with which a predetermined number of bills are bundled in the sealing device 1B. In accordance with the information designated by the supervisor in the strapper print setup window, the control unit 80 performs setup processing of setting contents to be printed on a strap (step S36).

When the supervisor touches the save button 104 (YES in step S37), the control unit 80 saves the setting contents in the save unit 81 (step S38). That is, when the save button 104 is operated, the control unit 80 saves the setting contents displayed in the cassette assignment window in the save unit 81 with the designated "preset". When the supervisor touches the return button 155 (YES in step S39), the control unit 80 closes the cassette assignment window shown in FIG. 7 which is displayed on the display unit 82 described above.

In the above cassette assignment window, bill types and bill states of bills to be assigned to the respective cassettes and the like are displayed in the form of graphical operation buttons. This makes it easy to set up the respective cassettes.

In addition, in the above cassette assignment window, when one condition is assigned to one cassette, a display field for setting another condition is displayed for the cassette. This makes it possible to set a plurality of conditions (a bill type and a bill state) for one cassette and allows easy checks of the plurality of conditions set for one cassette.

The above cassette assignment window allows easy assignment of cassettes to the respective bill types and displays the cassettes assigned to the respective bill types or the conditions for bills assigned to the respective cassettes so as to allow easy visual checking thereof. This makes it possible to reliably set the assignment of cassettes to the respective bill types and hence to prevent bills of a specific type from being rejected because of an assignment error.

A specific example of a setup sequence based on the above cassette assignment window will be described next.

A first specific example of the setup sequence will be described first.

As the first specific example, a sequence of assigning "20 Euro" and "10 Euro" to the cassette indicated by "A" (the cassette 41 of the sorting/collecting device 1A) will be described. Assume that all the state designation buttons 131 to 134 are set in the selected state according to the default settings ("Mix" is selected as both the first and second conditions as the condition for bills).

In this case, the supervisor selects the bill type designation button 113 for designating "20 Euro" as a bill type. If, for example, the bill type designation buttons 111 to 117 are set in the unselected state, the supervisor touches only the bill type designation button 113. The control unit 80 then sets the bill type designation button 113 for designating "20 Euro", which is displayed on the display unit 82, in the selected state. When the supervisor touches the field (line) of the cassette indicated by "A" in this state, the control unit 80 sets the field of the cassette indicated by "A" in the highlighted state (selected state).

When the supervisor touches the add button 141 while the display fields of the bill type and cassette are selected, the control unit 80 displays (adds) "20 Euro" in the field of the cassette indicated by "A". In this sequence, "20 Euro" bills are assigned to the cassette indicated by "A".

As described above, a plurality of conditions can be set as conditions for bills to be collected with respect to the cassettes 41 to 46 of the sorting/collecting device 1A. For this reason, the control unit 80 displays "20 Euro" in the field of the cassette indicated by "A" in the selected state, and also displays the new field (line) of the cassette indicated by "A".

If "10 Euro" is to be assigned to the cassette indicated by "A" as well as "20 Euro", the supervisor selects the bill type designation button 112 for designating "10 Euro". If, for example, all the bill type designation buttons 111 to 117 are set in the unselected state, the supervisor touches the bill type designation button 112. The control unit 80 then sets the bill type designation button 113 for designating "10 Euro" in the selected state. Note that when the bill type designation button 112 is touched, the control unit 80 may set the bill type designation button 112 in the selected state while setting the remaining bill type designation buttons in the unselected state.

When the supervisor touches the newly added field of the cassette indicated by "A" (the field in which "20 Euro" is not registered) in this state, the control unit 80 sets the newly added field of the cassette indicated by "A" in the highlighted state (selected state).

When the supervisor touches the add button 141 while the display field of the bill type and newly added cassette are in the selected state, the control unit 80 displays "10 Euro" in the newly added field (line) of the cassette indicated by "A" in the selected state. When a condition for bills to be collected can be set (three or more conditions can be set for one cassette), the control unit 80 adds a new field (line) for the cassette indicated by "A".

In the above sequence, "20 Euro" bills and "10 Euro" bills are assigned to the cassette indicated by "A". As a result, 10 Euro bills and 20 Euro bills are collected in the cassette 41 as the cassette indicated by "A". According to the above sequence as the first specific example, bills with a plurality of different conditions can be easily assigned to one cassette 41 (the cassette indicated by "A").

Note that selection of a cassette by the display fields of the respective cassettes, selection of a bill type by the bill type designation buttons, and selection of a bill state by the state designation buttons may be done in an arbitrary order.

A second specific example of the setup sequence will be described next.

As the second specific example, a sequence of assigning "20 Euro" fit bills (Fit) to "S1-1" and "S1-2" (cassettes 51 and 52 of the sealing device 1B) and assigning "20 Euro" unfit fills to the cassette indicated by "B" (the cassette 42 of the sorting/collecting device 1A) will be described.

In this case, first of all, the supervisor sets the bill type designation button 113 for designating "20 Euro" as a bill type in the selected state. If, for example, the bill type designation buttons 111 to 117 are in the unselected state, the supervisor touches the bill type designation button 113. The control unit 80 then sets the bill type designation button 113 for designating "20 Euro" displayed on the display unit 82 in the selected state.

The supervisor also sets the fit bill button 131 for designating "fit" as a bill state in the selected state, and sets the unfit bill button 132 in the unselected state. Assume that in the default state, all the fit bill button 131, unfit bill button 132, forward orientation button 133, and backward orientation button 134 as the state designation button 130 are in the selected state. In this case, the supervisor touches the unfit bill button 132. The control unit 80 then cancels the selected state of the unfit bill button 132 (sets the unfit bill button 132 in the unselected state). This means that the buttons of the state designation button 130 other than the unfit bill button 132 (the fit bill button 131, forward orientation button 133, and backward orientation button 134) are set in the selected state.

When the supervisor touches the field (line) of the cassette indicated by "S1-1" on the display window 101, the control unit 80 sets the field of the cassette indicated by "S1-1" in the highlighted state (selected state). When the supervisor touches the add button 141 while the display fields of the bill type and bill state (fit) are in the selected state, the control unit 80 displays "20 Euro" and "Fit (fit bill)" in the field of the cassette indicated by "S1-1".

In the display field (line) of the cassette indicated by "S1-1", "20 Euro" is displayed as a bill type, and "Fit" indicating fit bills is displayed, instead of "Mix" indicating the mix of fit and unfit bills, by the above sequence. In this case, as information indicating the orientations of bills, both the forward orientation and the backward orientation are selected, i.e., the mix of the forward orientation and the backward orientation (Mix) is set.

In this case, the selected cassette is not any of the cassettes in the sorting/collecting device 1A but is the cassette 51 in the sealing device 1B. For this reason, the control unit 80 adds no new display field for the cassette indicated by "S1-1".

In addition, bills with different conditions (bill type and bill state) can be assigned to the cassette 51 (cassette indicated by "S1-1") and cassette 52 (cassette indicated by "S1-2") in the sealing device 1B. In general, however, bills with the same conditions (bill type and bill state) are assigned to the cassette 51 (cassette indicated by "S1-1") and cassette 52 (cassette indicated by "S1-2") in the sealing device 1B. This is because while bills collected in one cassette are sealed, bills are collected in the other cassette.

When bills with the same conditions (bill type and bill state) are to be assigned to the cassette 51 (cassette indicated by "S1-1") and cassette 52 (cassette indicated by "S1-2") in the sealing device 1B, bills with the same conditions as those for "S1-1" are assigned to "S1-2" by a sequence similar to the above setup for "S1-1".

With this operation, "20 Euro" is displayed as a bill type in the display fields (lines) of the cassettes indicated by "S1-1" and "S1-2", and "Fit" indicating fit bills is displayed in the display fields, instead of "Mix" indicating the mix of fit and unit bills.

When "20 Euro" is to be assigned to the cassette indicated by "B", the supervisor selects the bill type designation button 113 for designating "20 Euro" as a bill type. If, for example, the bill type designation buttons 111 to 117 are set in the unselected state, the supervisor touches only the bill type designation button 113. The control unit 80 then sets the bill type designation button 113 for designating "20 Euro" in the selected state.

The supervisor also sets the unfit bill button 132 for designating "unfit" as a bill state in the selected state, and sets the fit bill button 131 in the unselected state. Assume that in the default state, all the fit bill button 131, unfit bill button 132, forward orientation button 133, and backward orientation button 134 as the state designation button 130 are in the selected state. In this case, the supervisor touches the fit bill button 131. The control unit 80 then cancels the selected state of the fit bill button 131 (sets the fit bill button 131 in the unselected state). This means that the buttons of the state designation button 130 other than the fit bill button 131 (the unfit bill button 132, forward orientation button 133, and backward orientation button 134) are set in the selected state.

When the supervisor touches the field (line) of the cassette indicated by "B" on the display window 101, the control unit 80 sets the field of the cassette indicated by "B" in the highlighted state (selected state). When the supervisor touches the add button 141 in this state, the control unit 80 displays "20 Euro" and "Unfit (unfit bill)" in the field of the cassette indicated by "B".

With this operation, in the display field (line) of the cassette indicated by "B", "20 Euro" is displayed as a bill type, and "Unfit" indicating unfit bills is displayed, instead of "Mix" indicating the mix of fit and unfit bills.

According to the above sequence of the second specific example, 20 Euro fit bills can be easily assigned to the cassette 51 (cassette indicated by "S1-1") and cassette 52 (cassette indicated by "S1-2") of the sealing device 1B, and 20 Euro unfit bills can be easily assigned to the cassette 42 (cassette indicated by "B") of the sorting/collecting device 1A.

Fitness level setting will be described next.

A fitness level is a threshold for sorting bills into fit bills and unfit bills. In an operation form of the sheet processing system, it is preferable to set a fitness level for each bill type. For this reason, the sheet processing system is configured to set a fitness level for each bill type. This is because it is required to sort bills into fit and unfit bills with different levels according to users, the application purposes of bills to be re-circulated, or bill types.

Figure 12:
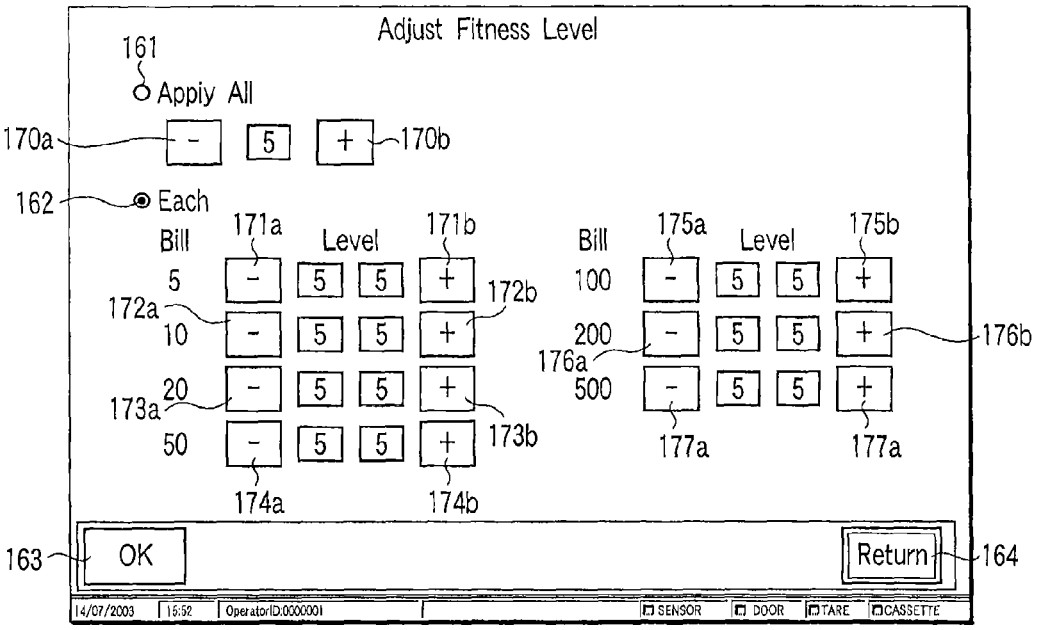
FIG. 12 is a view showing a display example of a fitness level setup window.

FIG. 12 shows a display example of the fitness level setup window.

As described above, when the supervisor touches the fitness level setup button 151 on the cassette assign window, the control unit 80 displays a fitness level setup window like that shown in FIG. 12. The fitness level setup window shown in FIG. 12 is provided with a common setup button 161, an individual setup button 162, a decision button 163, a return button 164, a plurality of minus buttons 170*a*, 171*a*, . . . , 177*a*, and plus buttons 170*b*, 171*b*, . . . , 177*b*.

The common setup button 161 is a button for setting a fitness level common to all bill types. The individual setup button 162 is a button for setting a fitness level for each bill type. The decision button 163 is a button for confirming the setting contents displayed on the window. The return button 164 is a button for instructing to return to the previous window (cassette assign window).

When a fitness level for the respective bill types is to be designated at once on the fitness level setup window shown in FIG. 12 (a fitness level common to the respective bill types is to be designated), the supervisor touches the common setup button 161. When the common setup button 161 is touched, the control unit 80 sets the common setup button 161 in the selected state to make it possible to set a fitness level common to the respective bill types.

While the common setup button 161 is in the selected state, the supervisor designates (inputs) a fitness level common to the respective bill types by operating the minus button 170*a* and plus button 170*b*. The value designated by the supervisor with the minus button 170*a* and plus button 170*b* is displayed as a fitness level value common to the respective bill types.

When a fitness level is to be designated for each bill type on the fitness level setup window shown in FIG. 12, the supervisor touches the individual setup button 162. When the individual setup button 162 is touched, the control unit 80 sets the individual setup button 162 in the selected state to make it possible to designate a fitness level for each bill type.

While the individual setup button 162 is in the selected state, the supervisor designates (inputs) a fitness level value for 5 Euro (10 Euro, 20 Euro, 50 Euro, 100 Euro, 200 Euro, and 500 Euro) by operating the minus button 171*a* (172*a*, 173*a*, 174*a*, 175*a*, 176*a*, and 177*a*) and the plus button 171*b* (172*b*, 173*b*, 174*b*, 175*b*, 176*b*, and 177*b*). The values designated by the supervisor are then displayed as fitness level values for the respective bill types in correspondence with the respective bill types.

According to the above fitness level setup window, a fitness level can be easily set for each bill type. This makes it possible for the sheet processing system to sort bills into fit and unfit bills according to different thresholds for the respective bill types. In addition, the above fitness level setup window makes it possible to set a fitness level for each bill type and set a fitness level common to a plurality of bill types at once. Therefore, a fitness level can be easily set in accordance with a demand from the user of the sheet processing system.

Preset setup will be described next.

As described above, setting contents such as settings for the respective cassettes set on the cassette assign window or the fitness level value set on the fitness level setup window and the like are saved in correspondence with a setup name called a "preset". That is, in the bill processing system, setting contents such as settings for the respective cassettes and a fitness level setting for each bill type can be saved as a plurality of patterns by a plurality of "presets".

These "presets" can be selected on, for example, the above cassette assign window. The setting contents of each such a "preset" can be easily changed (saved) and called. For example, during the operation of the bill processing system, a plurality of "presets" are selected by an operator (not limited to a supervisor) in accordance with the states of bills to be processed and the application purposes of bills after the processing. When the operator selects a desired "preset", the bill processing system reads the setting contents of the selected "preset" and performs operation setup for each component. Saving various types of setting contents corresponding to application purposes as a plurality of "presets" makes it possible to facilitate operation in accordance with application purposes and to make detailed setting in advance in accordance with application purposes.

Figure 13:
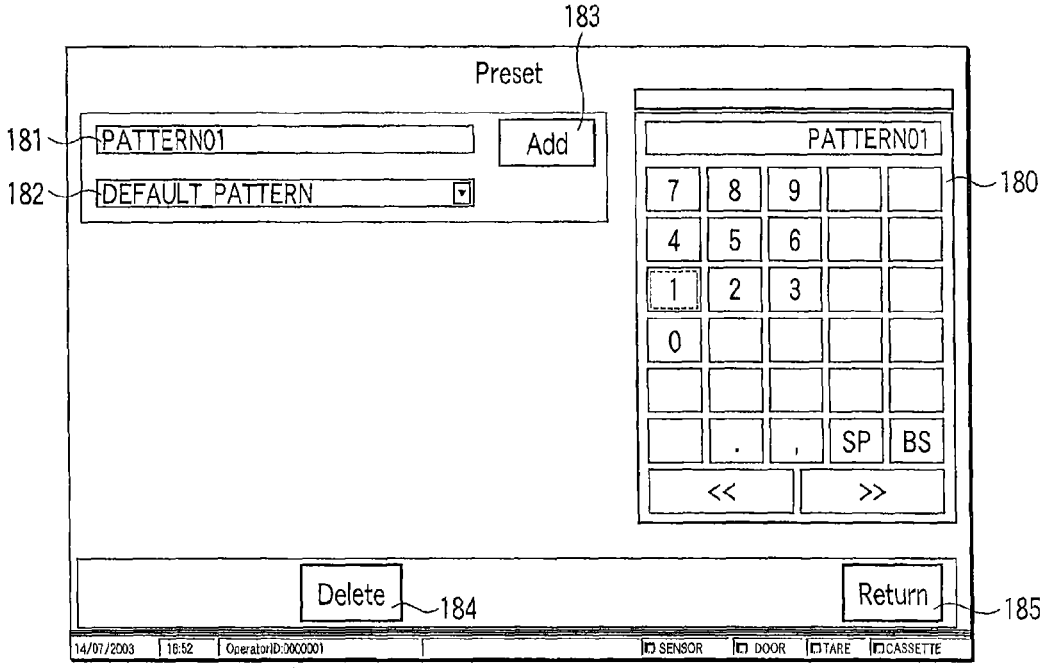
FIG. 13 is a view showing a display example of a preset generation window.

FIG. 13 is a view showing a display example of a preset generation window.

A preset (setup name) like that described above is generated by the supervisor on a preset generation window like that shown in FIG. 13. When, for example, the supervisor touches the preset button 154 on the cassette assign window shown in FIG. 7, the control unit 80 displays a preset generation window like that shown in FIG. 13.

The preset generation window shown in FIG. 13 displays a keyboard window 180, display window 181, display window 182, add button 183, delete button 184, return button 185, and the like. The keyboard window 180 has a plurality of buttons for inputting a "preset" (setup name). For example, the keyboard window 180 has a plurality of buttons for inputting numbers, symbols or characters. In the display example in FIG. 13, a ten-key pad is displayed as the keyboard window 180.

The display window 181 is an area which displays the "preset" input through the keyboard window 180. The display window 182 is an area which displays the "preset" selected from "presets" set in advance. The add button 183 is a button for instructing to register the "preset" displayed on the display window 181. The delete button 184 is a button for instructing to delete a selected "preset". The return button 185 is a button for instructing to return the display window to the previous window (e.g., the cassette assign window).

When, for example, a "preset" is to be generated, the supervisor touches the preset button 154 on a cassette assign window like that shown in FIG. 7. The control unit 80 then displays a preset generation window like that shown in FIG. 13. When the preset generation window is displayed, the supervisor inputs a name as a "preset" (setup name) through the keyboard window 180. The name input as a "preset" through the keyboard window 180 is displayed on the display window 181. When the supervisor touches the add button 183 in this state, the control unit 80 registers the name displayed on the display window 181 as a "preset".

On a preset generation window like that described above, the supervisor can generate a "preset" with an arbitrary name. This makes it easy to register a plurality of "presets". Setting contents of a plurality of patterns can registered with a plurality of "presets". In addition, since a plurality of "presets" can be registered with arbitrary names, a "preset" of setting contents suitable for an application purpose can be easily selected from the names of the respective "presets" at the time of operation.

An operation sequence at the time of operation will be described next.

An operation sequence for selecting a "preset" and executing processing for bills will be described below.

This bill processing system is configured to process bills on the basis of the setting contents saved with a "preset" like that described above. In general, an operator who has no right of supervision can execute processing for bills. Therefore, the operator designates one of a plurality of "presets" set in advance by using the display unit 82 and operation unit 83 of the controller 2. In response to this operation, the bill processing system reads the setting contents of the "preset"

selected by the operator and sets up the respective components. When the operator issues an instruction to start processing in this state, the bill processing system executes processing for bills on the basis of the read setting contents of the "preset".

Figure 14:
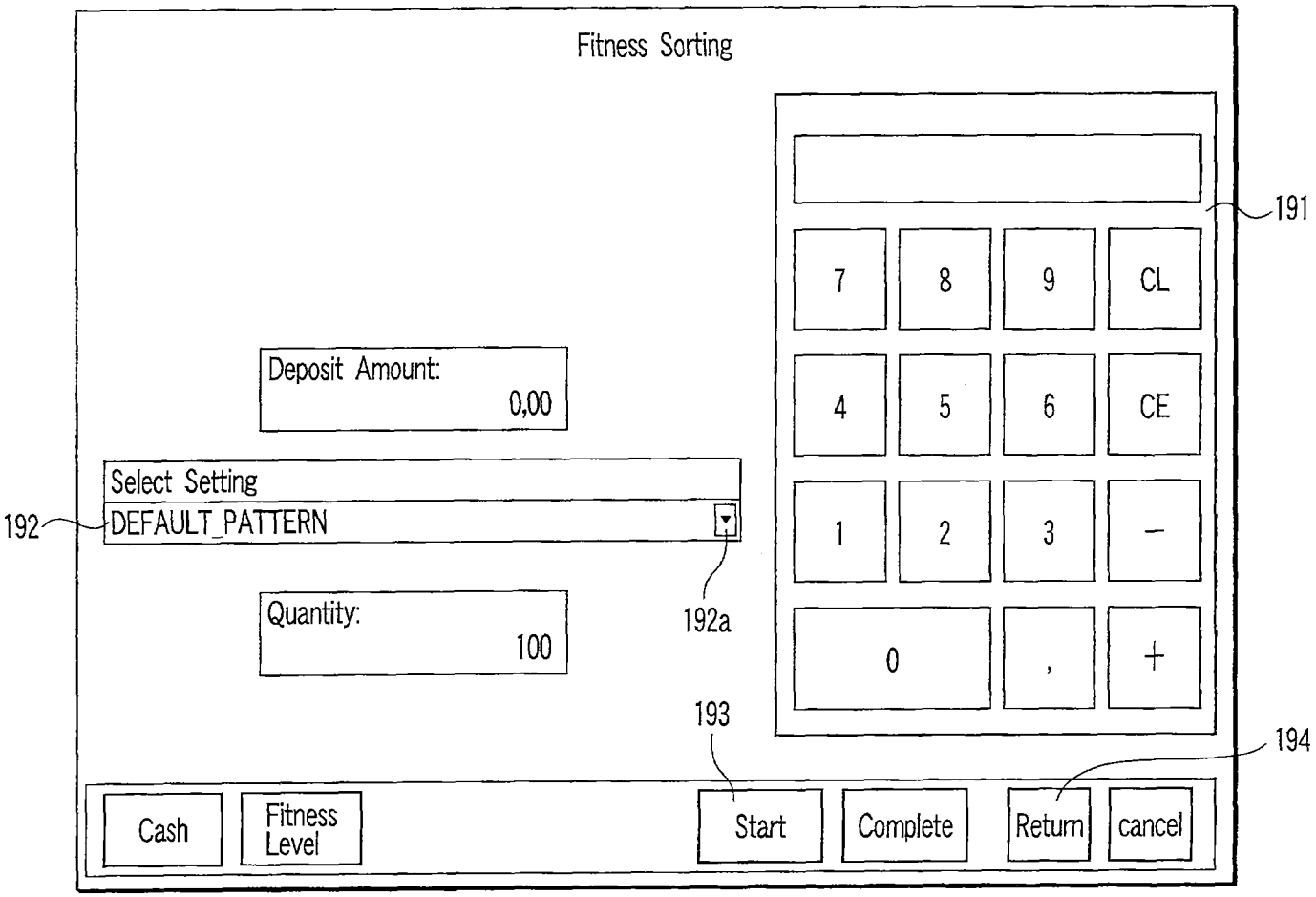
FIG. 14 is a view showing a display example of a selection window for selecting a "preset" in an operation sequence at the time of operation.

FIG. 14 is a view showing a display example of a selection window for allowing the operator who is to start processing for bills to select a "preset".

A preset selection window like that shown in FIG. 14 allows the operator who has no right of supervision to operate. When, for example, the operator who has no right of supervision logs in on a login window like that shown in FIG. 4, the preset selection window shown in FIG. 14 is displayed.

The preset selection window shown in FIG. 14 displays a keyboard window 191, display window 192, start button 193, return button 194, and the like. On the keyboard window 191, a ten-key pad is displayed as a keyboard. The display window 192 is an area which displays a selected "preset". In the example of the display window 192 shown in FIG. 14, a switching button 192*a* is displayed on an end portion of the display area.

The start button 193 is a button for instructing to process bills on the basis of the setting contents of the "preset" displayed on the display window 192. The return button 194 is a button for returning the display window to the previous window (e.g., the login window).

When, for example, the switching button 192*a* is touched, the control unit 80 displays a list of "presets" (setup names) set in advance and saved in the save unit 81. The operator touches a desired one of the "presets" displayed in the list in this manner. When one of the "presets" displayed in the list is touched, the control unit 80 displays the "preset" selected by the operator in the display area of the display window 192. At this time, the list of "presets" displayed on the window may be cleared. With this operation, a "preset" is selected on the preset selection window shown in FIG. 14.

When the operator touches the start button 193 in this state, the control unit 80 reads the setting contents of the selected "preset". In this case, the control unit 80 sets up the respective components on the basis of the setting contents of the "preset". When the setup of the respective components based on the selected "preset" is complete, the control unit 80 picks up the bills set in the pickup portion one by one and executes processing for the bill. This makes it possible to easily read the setting contents saved in the "preset" and easily perform collection processing in accordance with the setting contents.

In general, it is inconvenient to mix bills of a plurality of types in one sealed bundle. For this reason, a "preset" cannot be changed (selected) on the preset selection window shown in FIG. 14 unless at least all the bills in the cassettes 51 and 52 of the sealing device 1B are removed. In addition, the presence/absence of a bill in each cassette is detected by a sensor (not shown) provided for each cassette.

As described above, the bill processing system of this embodiment has the determination unit which checks a bill type and bill state and the plurality of cassettes in which the bills checked by the determination unit are collected. When a cassette and a bill type and bill state (unfitness degree or orientation) for bills to be collected in the cassette are selected on the graphical setup window displayed by the display unit, setup is performed to collect bills satisfying the selected conditions in the cassette. This makes it easy to set conditions for bills to be collected in each cassette.

When one condition is designated for one cassette on the above setup window, an operation means for designating another condition for the cassette is added to the setup window. This makes it possible to assign bills of a plurality of conditions such as a bill type and bill state to one cassette.

The setting contents set on the above setup window are saved with a plurality of "presets" (setup names) designated by the operator who has made the setting contents. The setting contents saved with these "presets" are then read on the basis of the selection of a "preset" by the operator to set up the respective components in the bill processing system. This makes it possible to save a plurality of setting contents corresponding to a plurality of application purposes in correspondence with "presets", and to easily and quickly perform setup in accordance with an application purpose at the time of operation of the bill processing system.

When an operation button for setting a threshold (fitness level) for determining whether a bill is a fit or unfit bill is operated on the above setup window, the fitness level setup window for setting a fitness level for each bill type is displayed, and a fitness level for each bill type which is designated on the fitness level setup window is saved as one setting content. This makes it possible to sort bills of each type into fit bills and unfit bills with a level corresponding to the request from the user side.

In addition, the above setup window displays a list of cassettes and conditions for bills, e.g., a bill type, fit bills, unfit bills, forward orientation, and backward orientation, which are assigned to each cassette in the list are displayed. This makes it easy to visually check conditions for bills which are assigned to each cassette.

In addition, on the above setup window, information indicating cassettes to which bills are assigned are displayed in the display fields indicating bill types and bill states such as fit bills, unfit bills, forward orientation, and backward orientation. This makes it easy to visually check cassettes to which bills of the respective types are assigned.

Furthermore, the above setup window is displayed only when the person who is operating the system is authenticated as a person who has the right of supervision by authentication information. This can prevent any unauthorized change in setting contents and can prevent any operator who has no right of supervision from easily changing settings.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A bill processing apparatus, comprising:

one or more strapping devices, each strapping device including one or two sheet collectors;

a sorting device, coupled to the strapping devices, and including a plurality of sheet collectors, the sorting device configured to check a bill type, a fit/unfit state, and to sort the bills into the sheet collectors of the sorting device and the strapping device; and a display unit configured to display information in a window format regarding the strapping device sheet collectors and the sorting device sheet collectors and associated conditions, including the bill type, fit/unfit state, for each bill to be received in each of the strapping device sheet collectors and the sorting device sheet collectors, wherein the sorting device comprises:

a first selection which enables selection of one of the sheet collectors from the strapping device sheet collectors or the sorting device sheet collectors that are displayed in a window of the display unit;

a second selection which selects one of the bill types that are displayed in a window of the display unit, as one of the conditions for each bill to be received in the selected strapping device sheet collector or selected sorting device sheet collector as selected by the first selection; and a third selection which enables adjustment of fit/unfit state thresholds that are displayed in a window of the display unit, as one of the conditions for each bill to be received in the selected strapping device sheet collector or selected sorting device sheet collector, the fit/unfit state thresholds determining whether each bill is a fit or unfit bill, and wherein the strapping device further comprises:

a strapper setting unit which, in response to the first selection selecting one of the strapping device sheet collectors, enables setting of contents to be printed on a strap via a window of the display unit, the printed strap being used to bundle a predetermined number of bills during a strapping operation.

* * * * *